US006929173B2

(12) United States Patent
Toussant et al.

(10) Patent No.: US 6,929,173 B2
(45) Date of Patent: Aug. 16, 2005

(54) REMOVABLE DECORATIVE MAILBOX COVER

(75) Inventors: Eric L. Toussant, Brownsburg, IN (US); Jeanne Carmody, Indianapolis, IN (US)

(73) Assignee: J. Carmody, Inc., Indianapolis, IN (US)

( * ) Notice: Subject to any disclaimer, the term of this patent is extended or adjusted under 35 U.S.C. 154(b) by 0 days.

(21) Appl. No.: 10/673,062

(22) Filed: Sep. 26, 2003

(65) Prior Publication Data

US 2005/0067480 A1 Mar. 31, 2005

Related U.S. Application Data

(63) Continuation of application No. 29/167,324, filed on Sep. 12, 2002, now Pat. No. Des. 493,598.

(51) Int. Cl.[7] ..... B65D 91/00
(52) U.S. Cl. ..... 232/38; 40/606.06
(58) Field of Search ..... 232/38, 17, 45; D99/29, 30; 40/606.06, 606.07, 594, 600, 599, 331, 332

(56) References Cited

U.S. PATENT DOCUMENTS

| | | | | | |
|---|---|---|---|---|---|
| 4,244,512 | A | | 1/1981 | Wise | |
| 4,368,842 | A | | 1/1983 | DeLange, III | |
| 4,375,869 | A | * | 3/1983 | Hatch | 232/17 |
| D287,899 | S | | 1/1987 | Lindheimer | |
| 4,652,239 | A | | 3/1987 | Brimberg | |
| 4,712,731 | A | | 12/1987 | Gramelspacher | |
| 4,813,595 | A | | 3/1989 | Johns, Jr. et al. | |
| 4,872,610 | A | | 10/1989 | Grabowiecki | |
| D305,824 | S | | 1/1990 | Carter | |
| 4,991,769 | A | | 2/1991 | Todd | |
| 5,000,379 | A | | 3/1991 | LaRue | |
| 5,035,356 | A | * | 7/1991 | Granger | 232/17 |
| 5,054,685 | A | | 10/1991 | Roach | |
| 5,067,650 | A | | 11/1991 | Jones et al. | |
| 5,102,171 | A | * | 4/1992 | Saetre | 283/117 |
| 5,106,016 | A | | 4/1992 | Beckmann | |
| 5,178,321 | A | | 1/1993 | Majewski | |
| 5,207,378 | A | | 5/1993 | Detchon | |
| 5,323,959 | A | | 6/1994 | Draper | |
| 5,334,431 | A | | 8/1994 | Longtin | |
| 5,346,125 | A | | 9/1994 | Critzer, Sr. | |
| D354,826 | S | | 1/1995 | Werner | |
| D354,837 | S | | 1/1995 | Owens | |
| 5,388,759 | A | | 2/1995 | Barnes | |
| 5,435,483 | A | | 7/1995 | Cox | |
| D371,888 | S | | 7/1996 | Tingler | |
| D371,889 | S | * | 7/1996 | Bollhardt | D99/30 |
| D375,394 | S | | 11/1996 | Hodges | |
| D376,891 | S | | 12/1996 | Wooten, Jr. et al. | |
| D385,676 | S | | 10/1997 | Childress et al. | |
| D402,783 | S | | 12/1998 | Lamolinara | |
| 5,943,803 | A | * | 8/1999 | Zinbarg | 40/606.06 |
| 5,970,638 | A | * | 10/1999 | Henley | 40/594 |
| 5,984,172 | A | | 11/1999 | Easterwood | |
| D420,197 | S | | 2/2000 | Arnold | |
| D421,327 | S | | 2/2000 | Quick | |
| D428,546 | S | | 7/2000 | Rempfer | |

(Continued)

*Primary Examiner*—William L. Miller
(74) *Attorney, Agent, or Firm*—Maginot, Moore & Beck

(57) ABSTRACT

A decorative cover for a mailbox door includes a sheet that is contoured to fit on the mailbox door. The sheet can include a cut-out to accommodate the mailbox latch. The front surface of the sheet carries a desired graphic, such as a decorative indicia or design. The cover sheet is formed of a material that allows substantially the entire back surface of the sheet to be attached directly to the mailbox cover by an affinity between the cover sheet material and the mailbox cover material. In one embodiment, this affinity is accomplished by magnetism through the use of a magnetic sheet. In an alternative embodiment, the affinity property is electrostatic or static cling.

10 Claims, 3 Drawing Sheets

U.S. PATENT DOCUMENTS 6,234,387 B1 5/2001 Cuthbert et al.
D443,971 S * 6/2001 Carr et al. ..... D99/30
D445,989 S * 7/2001 Carr et al. ..... D99/30
D449,727 S 10/2001 Carlson
6,296,180 B1 10/2001 Blizzard
6,308,884 B1 10/2001 Hamburger
D454,243 S * 3/2002 Pawlowski ..... D99/30
6,405,465 B2 * 6/2002 Dwyer et al. ..... 40/594
2002/0157294 A1 * 10/2002 Stanley ..... 40/600

* cited by examiner

REMOVABLE DECORATIVE MAILBOX COVER

This application is a continuation of and claims priority to U.S. design patent application Ser. No. 29/167,324, filed on Sep. 12, 2002 now U.S. Pat. No. D.493,598 and entitled "MAGNETIC MAILBOX COVER".

BACKGROUND OF THE INVENTION

The present invention relates to mailboxes and particularly to decorative covers for application on the mailbox.

Of course, the mailbox is a very well-known fixture. In one form, the mailbox is hung on an outer wall of a house. This type of mailbox has worked well in urban neighborhoods where the houses are densely packed and easily covered by the walking postal carrier. However, in rural settings where the postal carrier must deliver by vehicle, the mailboxes are situated at the roadside. Even in urban and suburban neighborhoods, the traditional wall-mounted mailbox has been replaced by the street-side mailbox.

The typical street-side mailbox approved by the U.S. Postmaster General is an elongated box with a curved upper surface. A hinged or pivoting door closes the open end of the box and is held in place by a friction latch. The general configuration of this type of mailbox is depicted in dashed lines in FIG. 1. In particular, the mailbox M includes an elongated hollow body 11 that is closed on five sides. The upper side is curved so that the front and back ends are rectangular at their lower ends but curved at the upper ends. A door 10 closes the open end of the body 11. The door is pivotably mounted to the box by a pivoting mount, such as a hinge 13, at the bottom of the door. A latch 12 at the top of the door frictionally holds the door in its closed position. The latch 12 includes a base 14 that is affixed to the surface of the door and projects downward from the upper edge of the door 10.

The typical "rural-type" mailbox is formed of sheet metal and is frequently corrugated along the length of the body 11 to add rigidity and strength to the body, especially for larger mailboxes. Likewise, the door 10 is typically formed with a peripheral rib 16 around the outer perimeter of the door. The rib thus defines a recessed surface 18 at the interior of the door 10. The rib 16 helps prevent twisting or deformation of the door when it is opened or closed.

Most approved mailboxes are relatively bland in appearance. Many mailboxes are painted, often to match a neighborhood decor. There are many devices that have been developed to enhance the appearance of the body 11 of the mailbox. One basic approach incorporates a rigid structure that is mechanically mounted over the mailbox body. One example of this approach is shown in U.S. Pat. No. 5,035,356.

In another approach, a sheet of material is mounted over the mailbox body. For instance, U.S. Pat. No. 4,813,595 shows a decorative overlay that is mechanically affixed to the lower edges of the mailbox body using removable fasteners. In another approach, U.S. Pat. No. 4,991,769 describes a polypropylene cover that is contoured to fit over the top of the mailbox body. The cover sheet includes magnetic strips adhered at the opposite side edges for magnetic attachment of the sheet to the mailbox body. The cover sheet can carry personal messages, as depicted in the patent.

A similar approach was taken in U.S. Pat. No. 5,000,379, except that the cover sheet is applied to the mailbox body by a pressure sensitive adhesive coating exposed by removing a peel-off backing sheet. Of course, with this design, the cover sheet is not easily removed, and may require scraping or chemical treatment to strip from the mailbox body. On the other hand, the entire back surface cover sheet includes the adhesive coating so that the sheet is more solidly affixed to the mailbox than the cover in the '769 Patent.

All of these approaches help spruce up the traditional post-mounted mailbox, and more particularly the body of the mailbox. However, none of these approaches suggest a way to decorate or individualize the door of the mailbox. A homeowner may not wish to have the entire mailbox body decorated, or the neighborhood covenants may not permit deviation from an identified mailbox color scheme. In addition, the prior covers are either substantially permanently attached or mechanically mounted to the mailbox body, making replacement extremely difficult when the homeowner desires a change in ornamentation. Other mailbox covers are only tenuously mounted to the mailbox so that they can be easily dislodged by heavy weather or drive-by vandalism. Moreover, the prior removably mounted mailbox body covers leave gaps between the cover and the underlying metal mailbox. Water can readily collected in these gaps, inevitably leading to rusting of the mailbox body.

Consequently, there remains a need for a decorative mailbox cover, and particularly a cover that is suited for mounting on the door of the mailbox. The cover must be readily removable and replaceable by covers having different decorative indicia.

SUMMARY OF THE INVENTION

These needs are met by the present invention which provides a decorative cover for the mailbox door. The cover includes a sheet that is contoured to fit on the mailbox door, preferably with a perimeter that matches the perimeter of the door. The sheet includes a cut-out to accommodate the mailbox latch. Most preferably, the sheet is sized to fit within the recessed surface on a typical approved mailbox door.

In one feature of the invention, the front surface of the sheet carries a desired graphic, such as a decorative indicia or design. The graphic can be pictorial or can include a topical message. A wide range of cover sheets can be provided to include a wide range of decorative graphics. For instance, holiday or seasonal depictions can be included on the front surface of the cover sheet.

In an important aspect of the invention, the cover sheet is formed of a material that allows substantially the entire back surface of the sheet to be attached to the mailbox cover by an affinity between the cover sheet material and the mailbox cover material. In one embodiment, this affinity is accomplished by magnetism through the use of a magnetic sheet. In an alternative embodiment, the affinity property is electrostatic or static cling. This affinity characteristic does not require any adhesive or any mechanical fasteners. Moreover, the decorative door cover with this affinity property can be easily and readily removed from the mailbox door without damaging the surface of the door and without the use of a tool or a chemical treatment.

Providing the affinity characteristic across substantially the entire area of the sheet allows the sheet to be attached to substantially the entire mailbox door. This complete attachment leaves no gaps between the sheet material and the door that may be encroached by the elements or that may leave the sheet susceptible to being dislodged It is one object of the invention to provide a mailbox cover that can be readily attached and easily removed. A further object is to provide such a cover that can carry a variety of decorative and informational displays so that a homeowner can keep several different covers to be used as desired. Other objects and certain benefits of the removable mailbox door cover of the present invention will be discerned from the following written description taken together with the accompanying figures.

DESCRIPTION OF THE PREFERRED EMBODIMENTS

Figure 1:
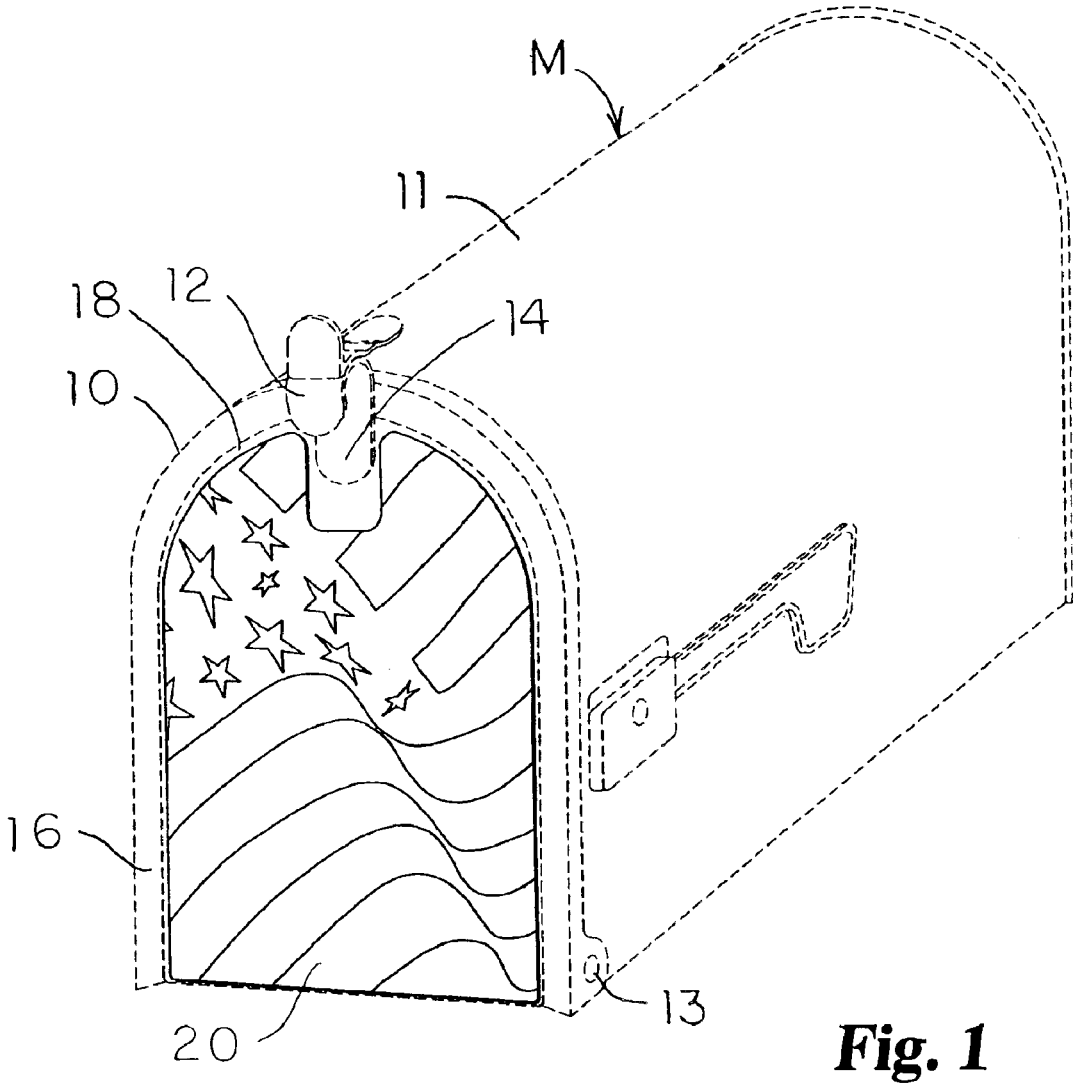
FIG. 1 is front perspective view of a mailbox, shown in dashed lines, with a removable mailbox cover in accordance with one embodiment of the present invention mounted thereon.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
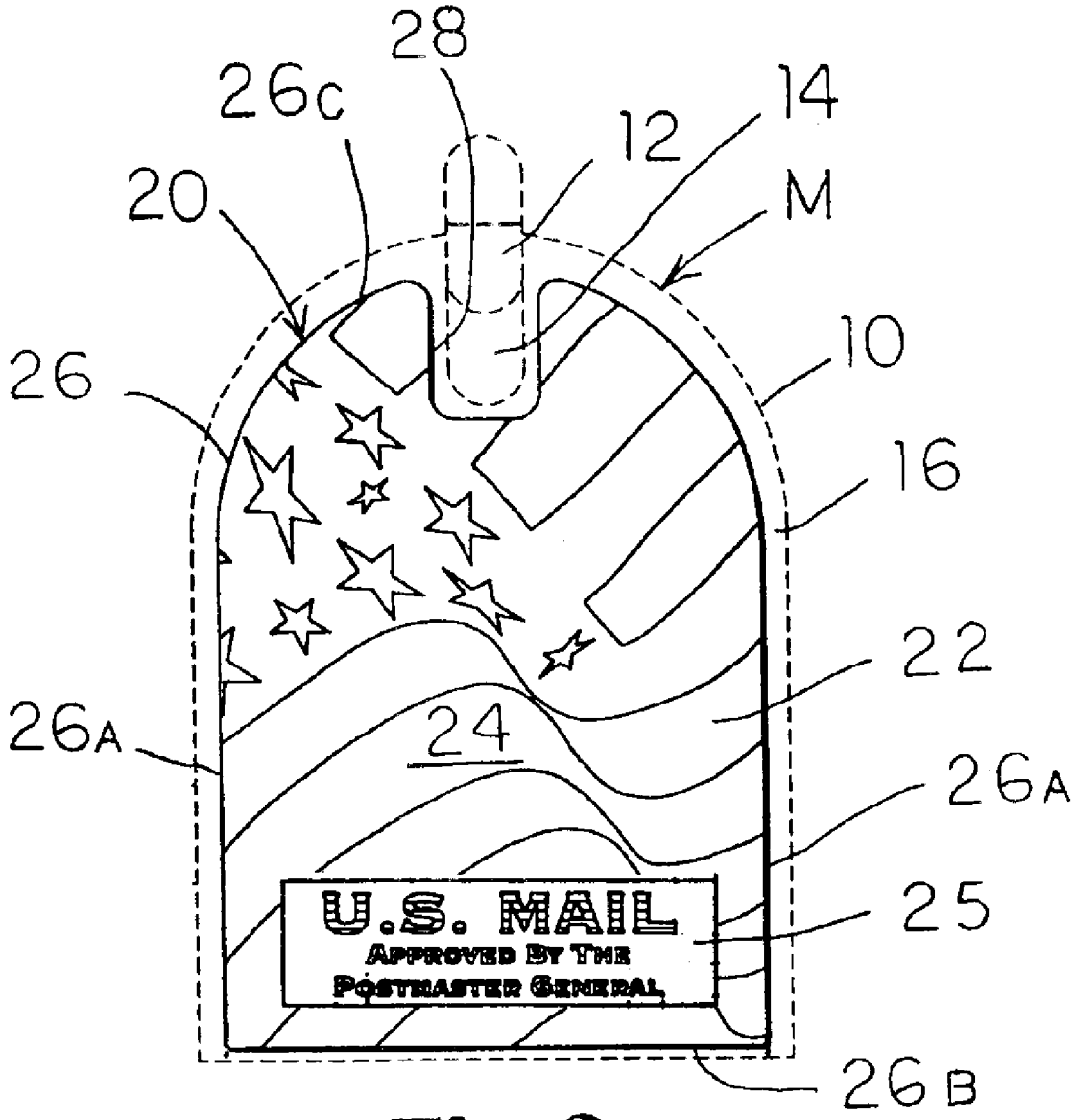
FIG. 2 is a front elevational view of the mailbox and removable mailbox cover shown in FIG. 1.
Figure 5:
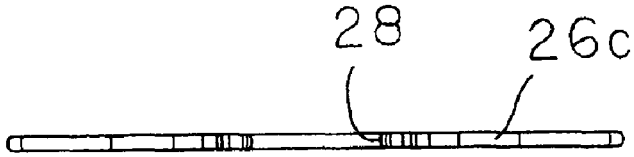
FIG. 5 is a top elevational view of the removable mailbox cover shown in FIG. 3.
Figure 4:
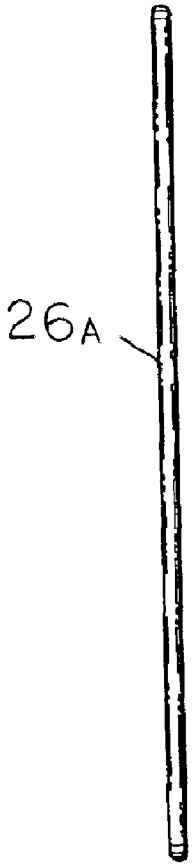
FIG. 4 is a side elevational view of the removable mailbox cover shown in FIG. 3.

As explained above, FIG. 1 includes a depiction of a typical post-mounted mailbox M with a removable door cover 20, in accordance with one embodiment of the invention, mounted thereon. The details of the door cover are shown best in FIGS. 2–6. The door cover 20 is formed from a flexible sheet 22 that carries graphics on its front surface 24. As shown in FIG. 2, the graphics can include, for instance, a representation of the American flag. Other pictures, symbols, expressions, etc., can also be graphically depicted on the front surface 24. It is contemplated that a homeowner may have several different door covers 20, each with different graphics for variations in aesthetic or informational effects.

Preferably, each graphic will include an approval legend 25, shown in FIG. 2. Regulations of the Postmaster General mandate the dimensions and make-up of all mailboxes. The approval legend is necessary to identify the mailbox as a proper receptacle for mail delivered by the U.S. Postal Service. According to the postal regulations, a postal carrier cannot deposit mail into a non-approved box. In most mailboxes, the approval legend is stamped into the door 10. Since the door cover 20 of the present invention is intended to completely cover the door, it should bear the appropriate approval legend 25.

Figure 3:
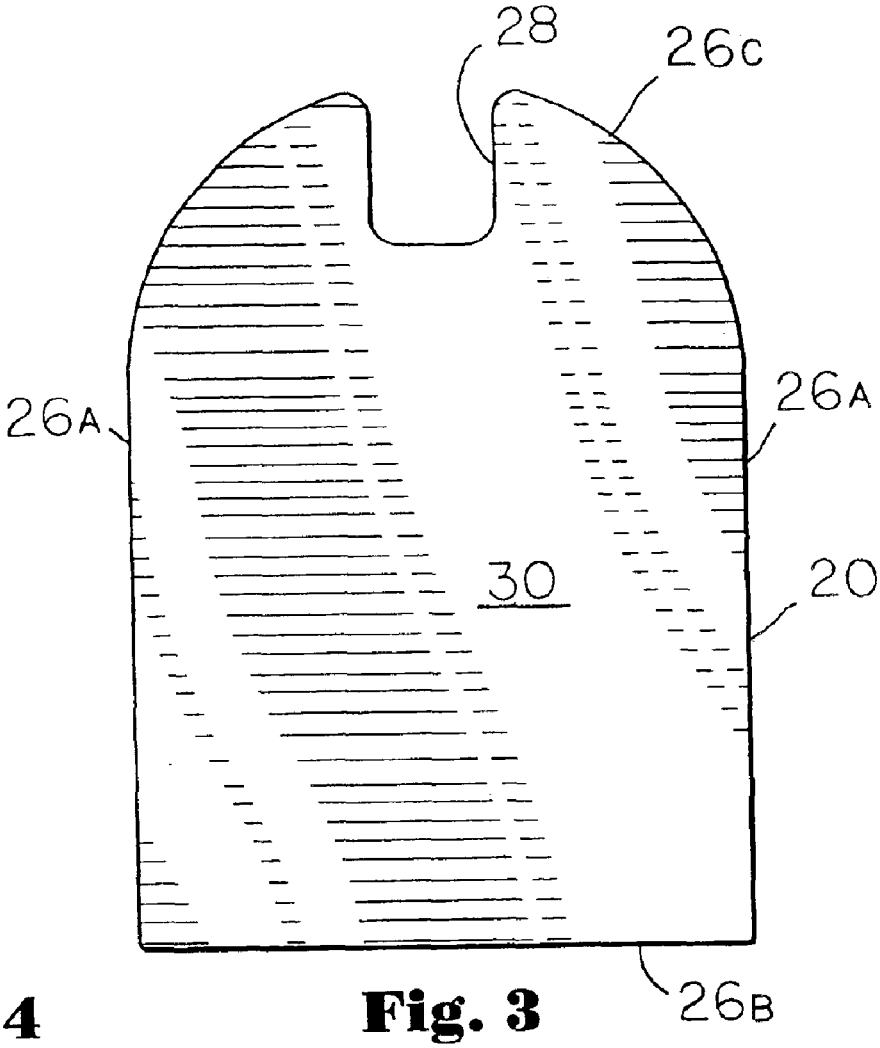
FIG. 3 is a rear elevational view of the removable mailbox cover shown in FIGS. 1 and 2.
Figure 6:
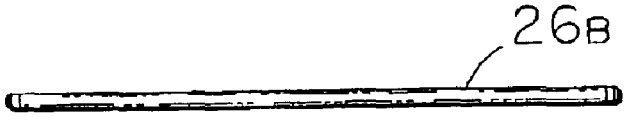
FIG. 6 is a bottom elevational view of the removable mailbox cover shown in FIG. 3.

The door cover 20 is configured to substantially fully occupy the available space on the mailbox door 10. In the embodiment depicted in the accompanying figures, the mailbox door includes a recessed surface 18, so the door cover 20 is configured to occupy substantially the entirety of that recessed surface. Thus, the door cover 20 includes a contoured perimeter 26 having opposite side edges 26A that follow the vertical extent of the door 10, a bottom edge 26B that follows the bottom extent of the door, and a curved upper edge 26C that generally conforms to the curved upper portion of the recessed surface 18 of the door. In order to accommodate the latch base 14, the upper edge 26C defines a cut-out 28. As shown in FIG. 3, the cover 20 has a contact surface 30 that is in intimate contact with the surface of the mailbox door 10.

In an important feature of the invention, the flexible sheet 22 is formed substantially of a material having a natural affinity for the material of the mailbox door 10. In a most preferred embodiment, the entire flexible sheet is formed of a magnetic material. In particular, the contoured door cover is cut from magnetic sheeting, such as ZIP-GRIP™ flexible magnetic sheeting sold by Master Magnetics, Inc., of Castle Rock, Colo. Magnetic sheeting incorporates magnetic polarity that generally runs parallel with an edge of the sheet, such as parallel to the side edges 26A of the sheet 22. Moreover, the polarity is focused on one side of the sheet, such as the contact surface 30 of the sheet 22. Thus, while the contact surface 30 will exhibit magnetic attraction or affinity for the mailbox door, the front surface 24 will not.

The magnetic sheeting can generate a magnetic field sufficient to firmly hold the sheet to the mailbox door. For instance, a 0.03 in. thick magnetic sheet can generate $0.78\times10^6$ gauss oersted field with a holding power of 85 lbs./sq.ft. Thinner magnetic sheeting will generate a lesser field, but the reduction in holding power is accounted for by a reduction in weight of the sheeting.

The present invention thus contemplates that the mailbox door cover is formed of a flexible sheet of a material that has an affinity for the material of the mailbox. The term "affinity" as used herein is intended to mean a characteristic of the sheet material that causes the material to attach to the mailbox door material without the use of adhesives or similar substances, and without the use of mechanical fasteners. In other words, the material includes means for attaching directly to the mailbox door without the use of glue, adhesive or similar chemicals, and without the use of mechanical fasteners, such as screws, tape or the like.

The term "affinity" in the context of the present invention also carries with it the property that allows the sheet material to be easily removed from the mailbox door without disrupting the surface of the door and without the need to use separate tools (such as a scraper) or separate chemicals (such as a chemical for releasing adhesive or glue). Thus, the magnetic material of the flexible sheet 22 of the preferred embodiment has an affinity for the metallic material of the mailbox door 10 because it attaches to the mailbox door without the need for adhesive or mechanical fasteners and because the magnetic sheet can be easily peeled off the door without separate tools or chemicals and without disrupting the surface of the mailbox door.

In accordance with the present invention, substantially the entire flexible sheet 22 is formed of the material having an affinity for the mailbox door. In this way, the entire sheet firmly attaches to the door, leaving virtually no gaps between the replaceable door cover 20 and the mailbox door 10. In the preferred embodiment, the removable sheet 22 is formed of a magnetic sheet having a thickness of about 0.015 inches. The display on the front surface 24 can be created by conventional ink screening techniques. The display can also be carried on a separate label that is adhesively applied to the front surface 24 of the sheet 22.

In an alternative embodiment of the invention, a different material can be used for the flexible sheet 22, in which the affinity property of the material is electrostatic or "static cling". An exemplary material can be a vinyl plastic or a polyester plastic, such as MYLAR™ provided by E. I. Du Pont de Nemours & Co., Inc. Like the magnetic material, the electrostatic or static cling material attaches to the mailbox door without the use of adhesive or mechanical fasteners. Removal of the electrostatic or static cling sheet does not disturb the surface of the mailbox door and does not require any mechanical or chemical means to release the sheet from the door. This alternative embodiment is particularly suited for mailbox doors formed of a variety of materials, including metal, plastic and ceramic.

The dimensions of the perimeter of the removable door cover 20 of the present invention are calibrated to the dimensions of the mailbox door. Most approved mailboxes come in three sizes with three differently sized doors. The smaller mailbox has a door with a height of about 8½ inches and a width of about 6¼ inches. An intermediate mailbox can have a door with a height of about 10½ inches and a width of 8 inches, while the "jumbo" mailbox dimensions are roughly 14.5" by 11". The flexible sheet is sized accordingly. As noted above, the thickness of the flexible sheet in one embodiment is 0.015 inches. The sheet may be provided in different thicknesses, although it is preferably that the thickness not be less than the 0.015 inches of the specific embodiment. If the sheet if too thin, it can be susceptible to tearing or creasing when being applied to or removed from a mailbox cover. A thicker sheet is stronger, but is also heavier, which may make the mailbox door prone to inadvertently popping open.

Some mailboxes include a peripheral rib, such as the rib 16 described above. In a preferred embodiment, the thickness of the flexible sheet 22 will not exceed the height of the rib 16. With this restriction on thickness, the door cover 20 will not project beyond the frontal plane of the mailbox door 10. Moreover, the edges 26A–C of the contoured perimeter 26 of the removable door cover will be protected against the inboard side of the peripheral rib 16 so that the edges cannot be accidentally caught and dislodged.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A cover for a mailbox door having a perimeter shape, in which the door includes a latch mounted thereon, said cover comprising a flexible sheet having a perimeter configured to substantially conform to the perimeter shape of the mailbox door, said sheet having a front surface with a graphic display thereon, said sheet formed of a material having an affinity for the mailbox door so that the sheet can be removably attached to the door without adhesive or mechanical fasteners, wherein said perimeter of said flexible sheet defines a notch corresponding to the location of the latch mounted on the mailbox door.

2. The cover for a mailbox door of claim 1, wherein said material of said flexible sheet is magnetic.

3. The cover for a mailbox door of claim 2, wherein said flexible sheet includes a contact surface opposite said front surface and said material exhibits a magnetic affinity only on said contact surface.

4. The cover for a mailbox door of claim 1, wherein said material exhibits an electrostatic affinity for the mailbox door.

5. The cover for a mailbox door of claim 1, wherein said material exhibits a static cling affinity for the mailbox door.

6. The cover for a mailbox door of claim 1, in which the mailbox door includes a peripheral rib, wherein said flexible sheet has a thickness that is less than or equal to the height of the peripheral rib.

7. A cover for a mailbox door having a perimeter shape, in which the door includes a latch mounted thereon, said cover comprising a flexible sheet having a perimeter configured to substantially conform to the perimeter shape of the mailbox door, said sheet having a front surface with a graphic display thereon, said sheet including means for attaching said sheet directly to the mailbox door without the use of glue, adhesive or mechanical fasteners, wherein said perimeter of said flexible sheet defines a notch corresponding to the location of the latch mounted on the mailbox door.

8. The cover for a mailbox door of claim 7, wherein said flexible sheet includes a contact surface opposite said front surface and said means for attaching is associated with said contact surface.

9. The cover for a mailbox door of claim 7, wherein said means for attaching includes said sheet formed of a magnetic material.

10. The cover for a mailbox door of claim 7, wherein said means for attaching includes said sheet formed of a material that exhibits an electrostatic affinity for the mailbox door.

* * * * *